United States Patent [19]

Akasaki et al.

[11] Patent Number: 4,933,245

[45] Date of Patent: Jun. 12, 1990

[54] ELECTROPHOTOGRAPHIC PHOTORECEPTOR

[75] Inventors: Yutaka Akasaki; Katsuhiro Sato; Naoya Yabuuchi; Kiroyuki Tanaka; Katsumi Nukada, all of Kanagawa, Japan

[73] Assignee: Fuji Xerox Co., Ltd., Tokyo, Japan

[21] Appl. No.: 98,333

[22] Filed: Sep. 18, 1987

[30] Foreign Application Priority Data

Sep. 18, 1986 [JP] Japan ..... 61-217952
Oct. 17, 1986 [JP] Japan ..... 61-245322

[51] Int. Cl.[5] ..... G03G 5/10

[52] U.S. Cl. ..... 430/59; 430/96; 564/309

[58] Field of Search ..... 430/59, 76, 78, 79, 430/96; 564/309

[56] References Cited

U.S. PATENT DOCUMENTS 3,265,496 8/1966 Fox ..... 430/58
4,047,948 9/1977 Horgan ..... 430/57
4,081,274 3/1978 Horgan ..... 430/58
4,299,897 11/1981 Stolka et al. ..... 430/59
4,588,666 5/1986 Stolka et al. ..... 430/59
4,629,671 12/1986 Everhardus et al. ..... 430/59

FOREIGN PATENT DOCUMENTS 11546 2/1964 Japan .
79450 3/1980 Japan .
134354 7/1986 Japan .
132955 10/1986 Japan .

*Primary Examiner*—John L. Goodrow
*Attorney, Agent, or Firm*—Sughrue, Mion, Zinn, Macpeak & Seas

[57] ABSTRACT

An electrophotographic photoreceptor is disclosed, which comprises an electrically conductive support having provided thereon a photoconductive layer containing, as a charge transport material, a compound represented by formula (I)

wherein $R_1$ represents an alkyl group, and $R_2$ and $R_3$, which may be the same or different, each represents a hydrogen atom, an alkyl group, an alkoxy group, a halogen atom, an alkoxycarbonyl group, or a substituted amino group. The photoreceptor satisfies both electrical and mechanical requirements without undergoing adverse influences from binder resins used therein.

15 Claims, 1 Drawing Sheet

ELECTROPHOTOGRAPHIC PHOTORECEPTOR

FIELD OF THE INVENTION

This invention relates to an electrophotographic photoreceptor having a photoconductive layer containing an N,N,N',N'-tetraarylbenzidine compound as a charge transport material.

BACKGROUND OF THE INVENTION

Photoreceptors for electrophotography include those in which a photoconductive layer has a single layer structure and those in which a photoconductive layer has a laminated structure. In recent years, many proposals have been directed particularly to organic photoreceptors whose photoconductive layer contains an organic photoconductive material dispersed in a binder resin and has the layer structure of separate function composed of a charge transport layer and a charge generating layer, as disclosed, e.g., in Japanese patent application (OPI) Ser. Nos. 52756/81 and 73743/82 (the term "OPI" as used herein means an "unexamined published Japanese patent application"). Binder resins proposed for use in the charge transport layer include polycarbonate resins, polyester resins, polymethyl methacrylate resins, bisphenol Z polycarbonate resins as described in Japanese patent application (OPI) Ser. No. 71057/84, and the like.

However, application of electrophotographic photoreceptors containing the above-described organic photoconductive materials and binder resins to commonly employed electrophotographic systems, such as a Carlson process, has been accompanied by various problems. For example, a charge transport material forms a charge transfer complex with some specific resins used as binder resin for a charge generating material. As a result, the photoreceptor entirely fails to be charged, or the charge transport material undergoes deterioration due to changes with time to cause so-called photofatigue.

Further, in photoreceptors in which a charge transport layer containing a charge transport material and a binder resin is provided as an outermost layer (top layer), problems such as adhesion of toners onto the charge transport layer, wear or scratches of the charge transport layer due to contact with a developer or transfer paper, and the like occur. The aforesaid polycarbonate resins, polyester resins, polymethyl methacrylate resins, or the like are unsatisfactory to solve these problems, exhibiting insufficient electrophotographic characteristics when used as binder resin in the charge transport layer. On the other hand, the bisphenol Z polycarbonate resins have a disadvantage when used as binder resin in combination with some specific charge transfer materials in that the resulting photoreceptors are not charged at all.

SUMMARY OF THE INVENTION

One object of this invention is to overcome the above-described problems associated with the conventional techniques and to provide an electrophotographic photoreceptor which is clearly chargeable and exhibits satisfactory sensitivity.

Another object of this invention is to provide an electrophotographic photoreceptor which is free from deterioration in charging properties and sensitivity over time.

A further object of this invention is to provide an electrophotographic photoreceptor which satisfies both electrical durability, such as charging properties and sensitivity, and mechanical durability, such as abrasion resistance and toner filming properties.

As a result of extensive studies on charge transporting compounds, it has now been found that N,N,N',N'-tetraarylbenzidine compounds represented by formula (I) hereinafter described exhibit excellent electrophotographic performance as charge transport material without undergoing adverse influences from binder resins used in combination. The present invention has been completed based on this finding.

The electrophotographic photoreceptors according to the present invention comprises an electrically conductive support having provided thereon a photoconductive layer containing an N,N,N',N'-tetraarylbenzidine compound represented by formula (I)

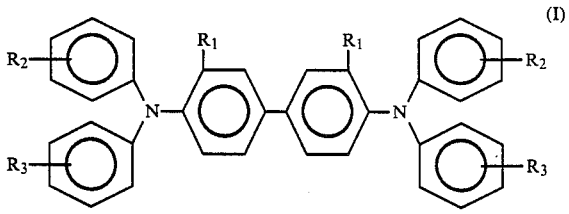

wherein $R_1$ represents an alkyl group, and $R_2$ and $R_3$, which may be the same or different, each represents a hydrogen atom, an alkyl group, an alkoxy group, a halogen atom, an alkoxycarbonyl group, or a substituted amino group.

BRIEF DESCRIPTION OF THE ACCOMPANYING DRAWINGS

DETAILED DESCRIPTION OF THE INVENTION

Figure 1:
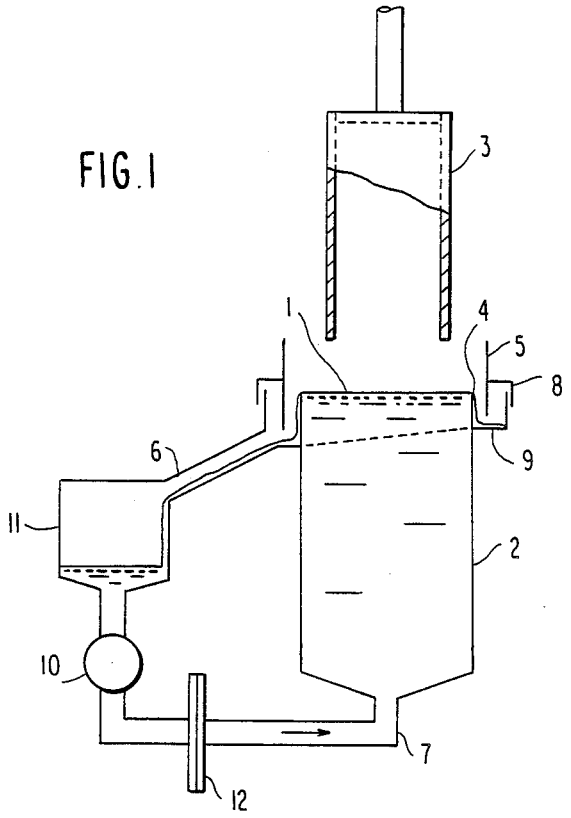
FIG. 1 illustrates a schematic cross section of a dip-coating apparatus to be used for producing electrophotographic photoreceptors of the present invention.

In formula (I), $R_1$ represents an alkyl group having preferably from 1 to 5 carbon atoms and more preferably from 1 to 2 carbon atoms; and $R_2$ and $R_3$ each represents a hydrogen atom, an alkyl group having preferably from 1 to 10 carbon atoms and more preferably from 1 to 4 carbon atoms, an alkoxy group having preferably from 1 to 10 carbon atoms and more preferably from 1 to 4 carbon atoms, a halogen atom, e.g., Cl, Br, etc., an alkoxycarbonyl group having preferably from 2 to 5 carbon atoms and more preferably from 2 to 3 carbon atoms, or a substituted amino group such as those substituted with an alkyl group preferably having 1 or 2 carbon atoms, e.g., a dimethylamino group, a diethylamino group, etc.

Of the compounds represented by formula (I), preferred are those represented by formula (II)

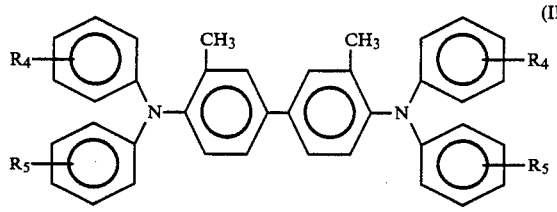

(II)

wherein $R_4$ and $R_5$, which may be the same or different, each represents a hydrogen atom or a methyl group, and those represented by formula (III)

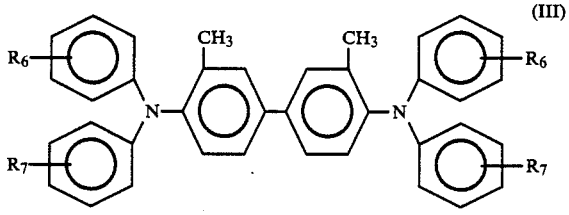

(III)

wherein either one of $R_6$ and $R_7$ represents an alkyl group having 2 or more carbon atoms, and the other represents a hydrogen atom, an alkyl group, an alkoxy group, a halogen atom, an alkoxycarbonyl group, or a substituted amino group.

More preferred among them are a compound of formula (IV)

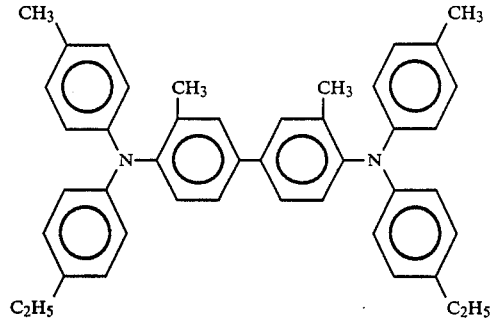

(IV)

and a compound of formula (V)

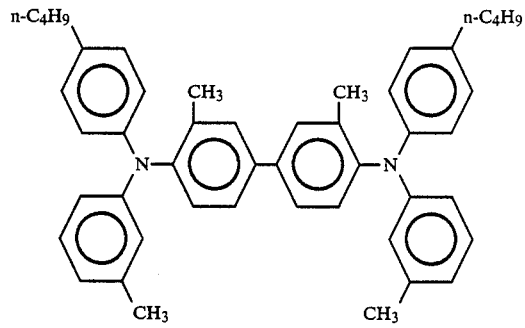

(V)

The compounds represented by formula (III) have markedly high solubility in solvents, e.g., toluene, chlorobenzene, 1,1,2-trichloroethane, tetrahydrofuran, 1,4-dioxane, cyclohexanone, etc. For example, solubility of the compounds of formulae (IV) and (V) in toluene or chlorobenzene is shown in Table 1 below in comparison with other N,N,N',N'-tetraarylbenzidine compounds, in which superior solubility of these compounds is demonstrated.

TABLE 1

| Compound | Solubility (mg/ml*) in Toluene | Solubility (mg/ml*) in Chlorobenzene |
|---|---|---|
| 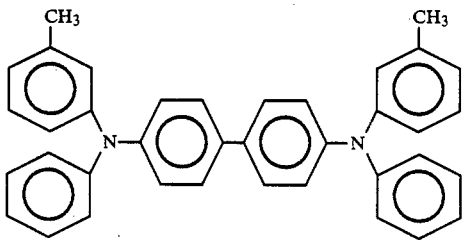 | 146 | 195 |
| 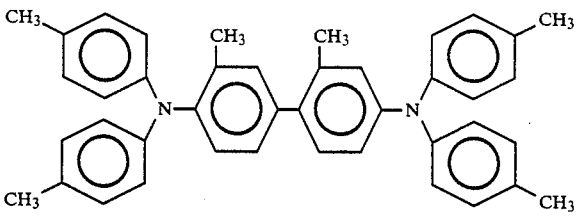 | 46 | 88 |

TABLE 1-continued

| Compound | Solubility (mg/ml*) in Toluene | Solubility (mg/ml*) in Chlorobenzene |
|---|---|---|
| 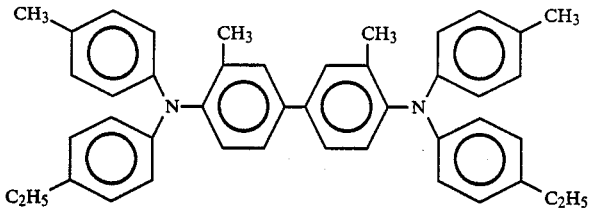 | 327 | 431 |
| 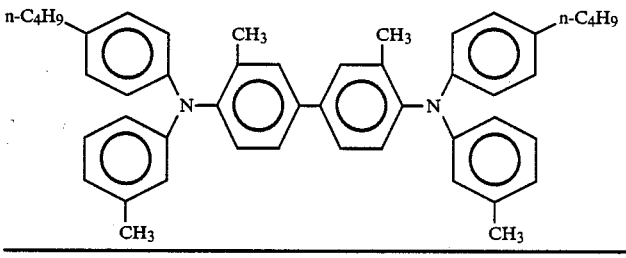 | >500 | >500 |

*Note:
Solubility on stirring at room temperature for one hour.

Therefore, the compounds of formulae (IV) and (V) can be incorporated into a coating composition for a photoconductive layer in increased concentrations. Further, use of these compounds can increase the viscosity of a coating composition, thus making it possible to coat a charge transport layer to a large thickness and to reduce sag of a coating film.

In addition to the compounds of formulae (IV) and (V), specific examples of the compounds represented by formula (I) are shown below. In the following formulae, Me represents a methyl group; Et represents an ethyl group; Pr represents a propyl group; and Bu represents a butyl group.

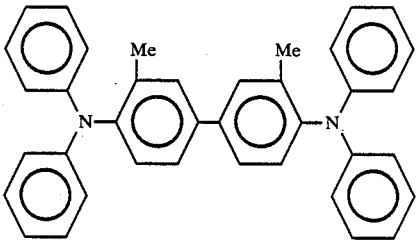

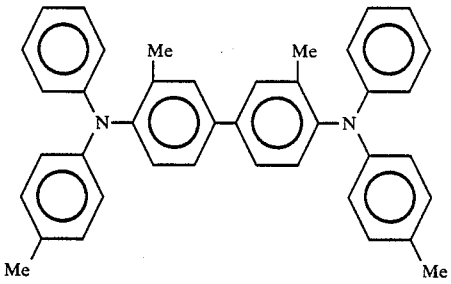

-continued

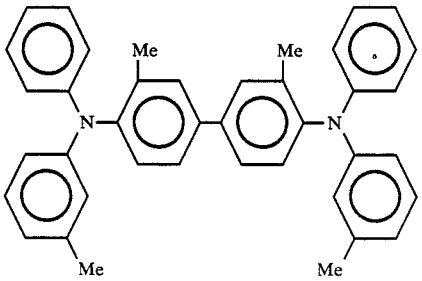

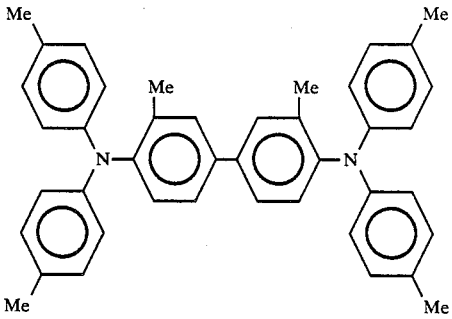

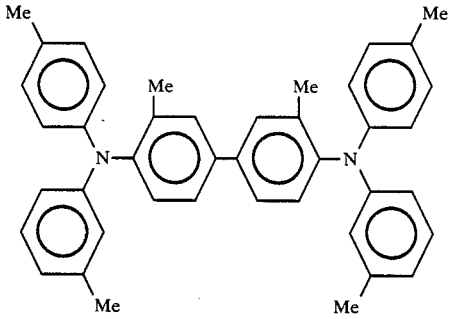

-continued
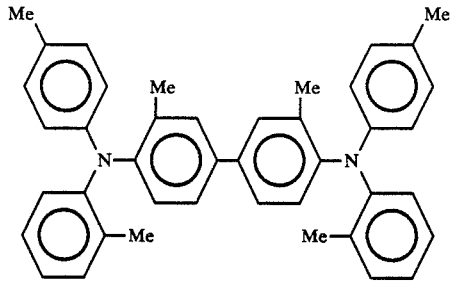
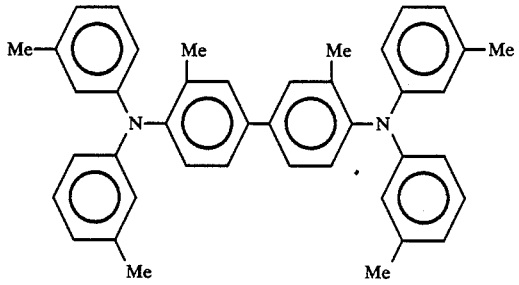
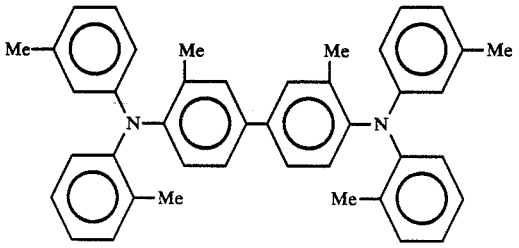
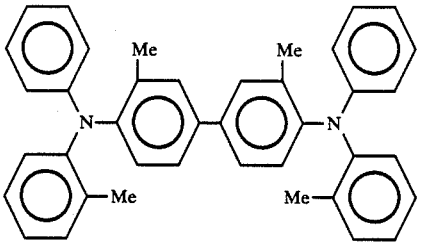
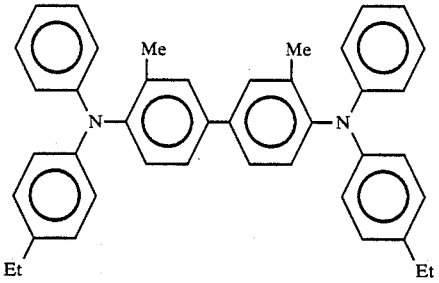
-continued
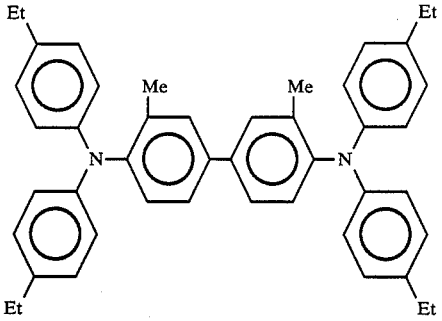
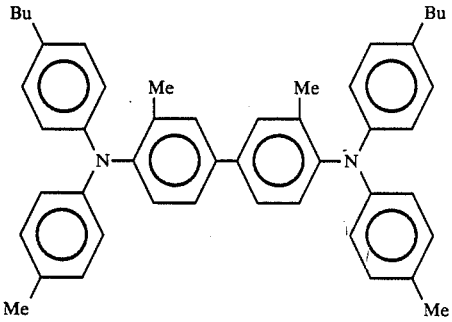
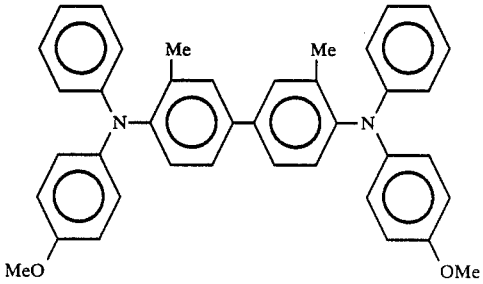
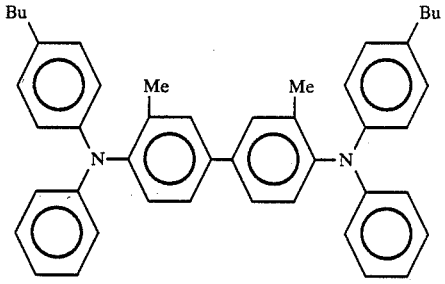
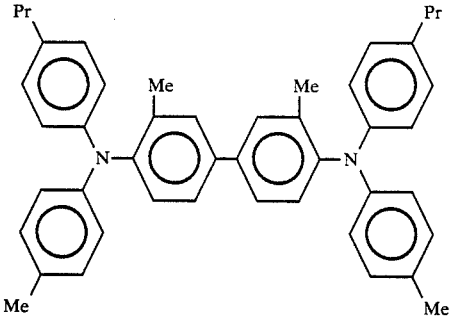

-continued
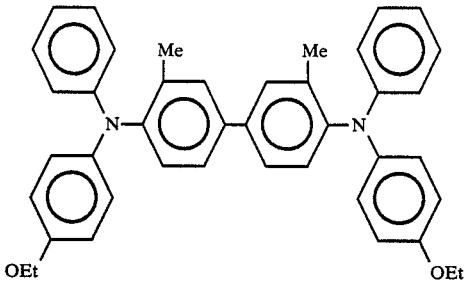
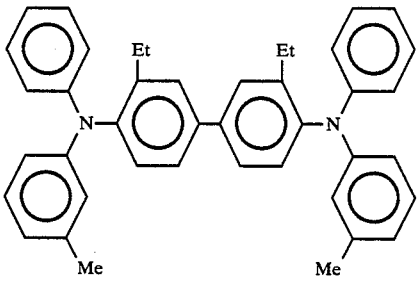
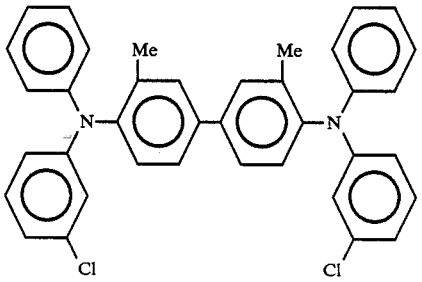
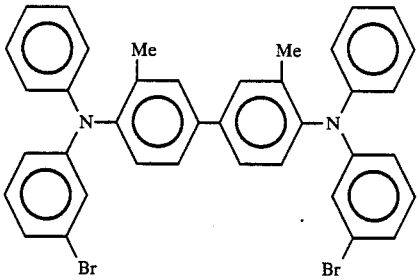
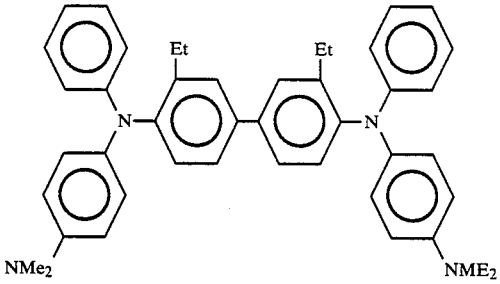
-continued
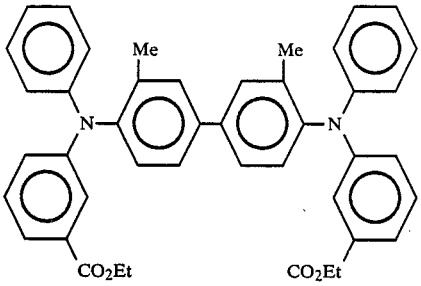
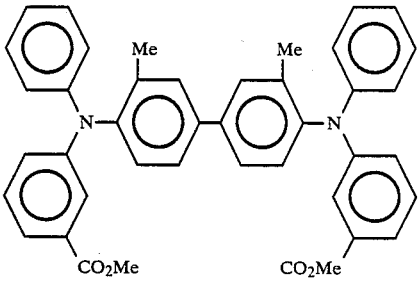
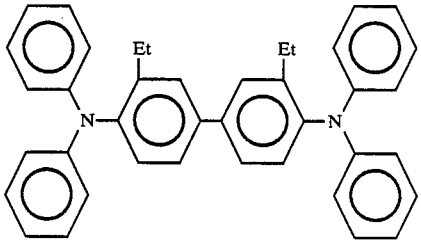
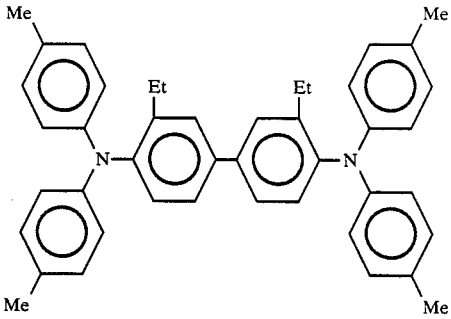
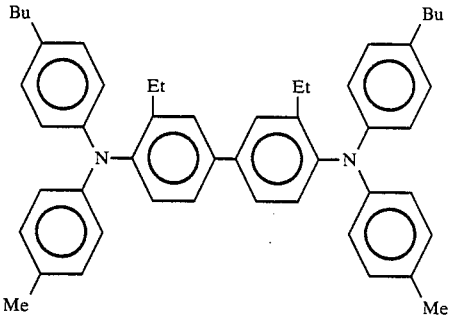

-continued

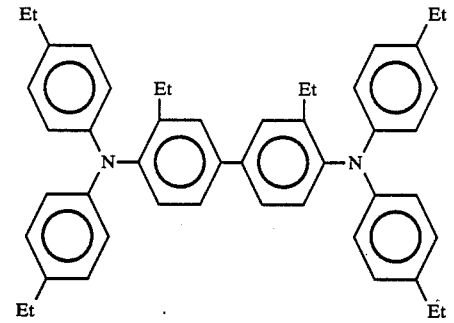

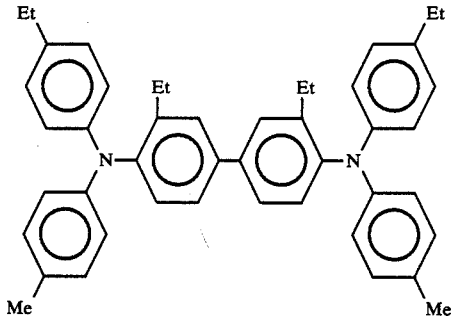

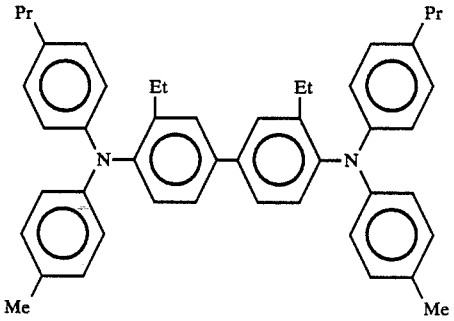

The N,N,N'N'-tetraarylbenzidine compounds represented by formula (I) can be prepared by reacting a halogenated benzene derivative represented by formula (VI)

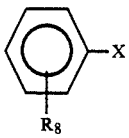

(VI)

wherein $R_8$ represents a group as defined for $R_2$ and $R_3$ above and X represents an iodine atom or a bromine atom, with a benzidine derivative represented by formula (VII)

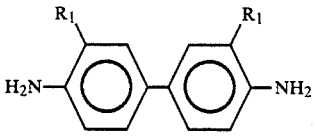

(VII)

wherein $R_1$ is as defined above, in the presence of a copper catalyst and an alkali.

The starting halogenated benzene derivatives of formula (VI) are easily available and preferably include those wherein $R_8$ is a hydrogen atom, an alkyl group or an alkoxy group and x is an iodine atom, such as iodobenzene and 2-, 3- or 4-iodotoluene. By using the halogenated benzene derivatives having different groups for $R_8$, the compounds of formula (I) having different groups for $R_2$ and $R_3$ can be obtained.

The starting benzidine derivatives of formula (VII) are also easily available and include 3,3'-dimethylbenzidine, etc.

The condensation reaction between the compound of formula (VI) and the compound of formula (VII) can be carried out in the presence of a copper catalyst and an alkali, with or without a reaction solvent, under heating.

The reaction solvent, if used, preferably includes high-boiling hydrocarbon solvents such as those having a boiling point of from 100° to 250° C., e.g., dodecane, tridecane, etc. Since this reaction is a dehydrating reaction and is susceptible to influences of water, hydrocarbon solvents having poor water solubility are preferred. In the case of using the hydrocarbon solvents, the compounds of formula (I) can be obtained in high yield with reduced incorporation of impurities so that they can be purified easily without using timeconsuming means, such as column chromatography.

The copper catalyst to be used includes a copper powder, $Cu_2O$, CuI, CuO, copper bronze, phosphor bronze, etc., and is preferably added in an amount of from 0.1 to 2 moles per mole of the benzidine derivative of formula (VII). The alkali to be used includes KOH, $K_2CO_3$, NaH, NaOH, $Na_2CO_3$, KH, $CaH_2$, etc. The alkali is generally added in an amount of 4 moles or more, preferably from 4 to 50 moles, and more preferably from 6 to 20 moles, per mole of the benzidine derivative. The condensation reaction is usually carried out at a temperature ranging from 100° to 250° C. and preferably from 150° to 230° C.

The halogenated benzene derivative of formula (VI) is used in an amount of at least 4 moles, preferably from 4 to about 20 moles, per mole of the benzidine derivative of formula (VII).

After completion of the reaction, water is added to the reaction mixture, and the product is extracted with a solvent which is capable of dissolving the product and is insoluble in water (e.g., methylane chloride, chloroform, an ether, toluene, etc.). The extract is treated with activated clay and then recrystallized from an appropriate solvent (e.g., acetone, ethyl acetate, an alcohol, hexane, toluene, methylene chloride, a mixture of the aforesaid solvents, chloroform, etc.). It is also possible to isolate the product in the course of the reaction. For example, the reaction is once suspended, and after the desired product is recovered by extracting with a solvent, etc., the reaction may be continued by replenishing the system with fresh catalyst, alkali, and starting compounds. In this case, a deactivated catalyst or alkali can be removed in the course of the reaction, and the overall reaction time can be shortened.

According to the above-described process, the compounds of formula (I) having high purity can be obtained from easily available starting materials through a simple and easy step.

The above-described process can also be applied for the production of other N,N,N',N'-tetraarylbenzidine compounds such as those represented by formula (VIII)

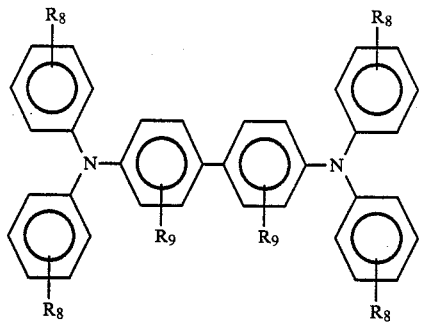

(VIII)

wherein $R_8$ is as defined above, and $R_9$ represents a hydrogen atom, an alkyl group having preferably from 1 to 5 carbon atoms and more preferably from 1 to 2 carbon atoms, or an alkoxy group having preferably from 1 to 5 carbon atoms and more preferably from 1 to 3 carbon atoms (e.g., a methoxy group, an ethoxy group, a propoxy group, etc.), that is, by reacting the halogenated benzene derivative represented by formula (VI) with a benzidine derivative represented by formula (IX)

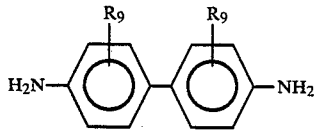

(IX)

wherein $R_9$ is as defined above, such as 2,2'-dimethylbenzidine, 2,2'-dimethoxybenzidine, 3,3'-dimethoxybenzene, etc.

Specific examples of the compounds represented by formula (VIII) in addition to those of formula (I) are shown below.

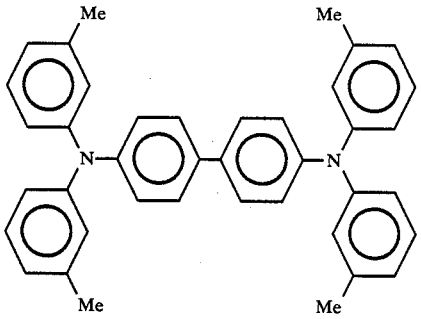

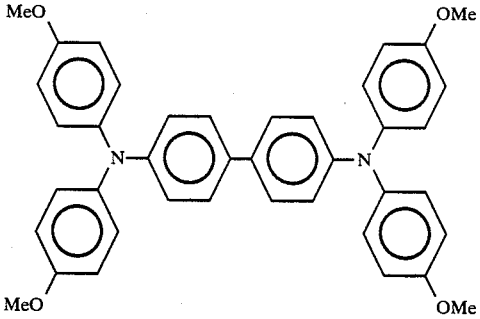

-continued

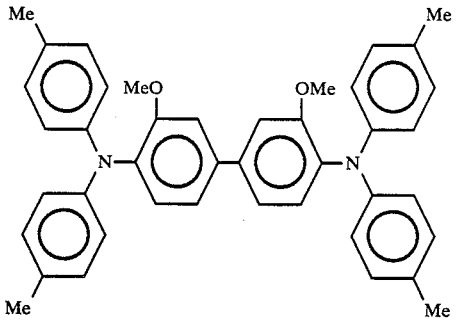

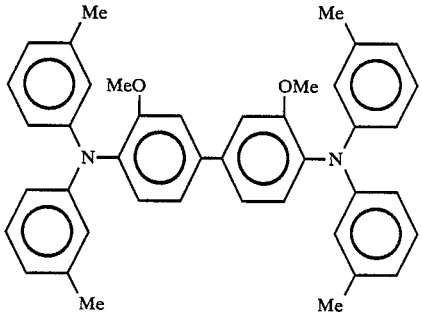

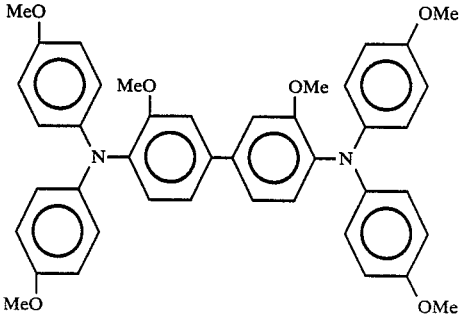

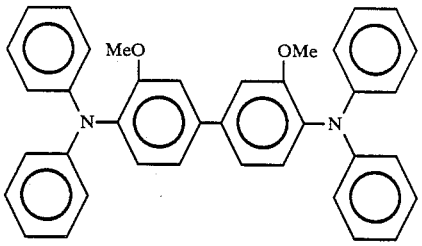

SYNTHESIS EXAMPLE 1

Preparation of N,N,N',N'-Tetrakis-(4-methylphenyl)-3,3'-dimethylbenzidine

In a round flask were charged 3.14 g (13.8 mmol) of o-tolidine, 40 g of potassium hydroxide, 400 mg of copper iodide, and 30 ml of n-dodecane, and the mixture was heated at 180° C. in a nitrogen stream. To the mixture was added dropwise 24.0 g (110 mmol) of 4-iodotoluene, and the heating at 180° C. was continued for 5 hours. Water was added to the reaction mixture, and the mixture was extracted with toluene. In order to assure completion of the reaction, the solvent was once removed by distillation, and 40 g of potassium hydroxide, 400 mg of copper iodide, and 24.0 g (110 mmol) of 4-iodotoluene were added to the residue, followed by allowing to react at 180° C. for 5 hours in a nitrogen stream. Water was added, and the mixture was extracted with toluene. The extract was dried over sodium sulfate and then treated with activated clay. The solvent was removed by distillation to obtain 5.98 g (yield: 75.7%) of N,N,N',N'-tetrakis-(4-methylphenyl)-3,3'-dimethylbenzidine, which was recrystallized from a mixed solvent of toluene/acetone/hexane to obtain 4.32 g (final yield: 54.7%) of a white crystal having a melting point of 174°-175° C. Analysis by high performance liquid chromatography revealed that the product has a high purity of 99.9%.

SYNTHESIS EXAMPLE 2

Preparation of N,N,N',N'-Tetraphenyl-3,3'-dimethylbenzidine

In a round flask were charged 4.25 g (20.0 mmol) of o-tolidine, 50 g of potassium hydroxide, 500 mg of copper iodide, and 30 ml of n-dodecane, and the mixture was heated at 180° C. in a nitrogen stream. To the mixture was added dropwise 24.48 g (120 mmol) of iodobenzene, followed by allowing the mixture to react at 180° C. for 6 hours. Water was added thereto, and the mixture was extracted with toluene. The extract was dried over sodium sulfate and treated with activated carbon. The solvent was removed by distillation to obtain 6.30 g (yield: 60.9%) of N,N,N',N'-tetraphenyl-3,3'-dimethylbenzidine. Recrystallization from a mixed solvent of benzene/n-hexane gave 4.79 g (final yield: 46.3%) of a white crystal having a melting point of 175°-178° C.

The N,N,N',N'-tetraarylbenzidine compounds represented by formula (I) can also be prepared by reacting a dihalobiphenyl derivative represented by formula (X)

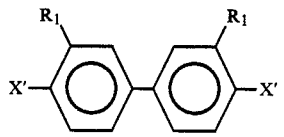

(X)

wherein $R_1$ is as defined above and X' is a halogen atom, with a diarylamine derivative represented by formula (XI)

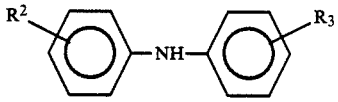

(XI)

wherein $R_2$ and $R_3$ are as defined above, in the presence of a catalyst (e.g., copper powder) and an alkali salt (e.g., $K_2CO_3$) in a solvent at a temperature of from about 180° to 230° C. The alkali salt is added in an amount sufficient to neutralize a hydrogen halide generated during the condensation reaction and generally more than 1 mole per mole of the diarylamine derivative.

SYNTHESIS EXAMPLE 3

Preparation of N,N,N'N'-Tetraphenyl-3,3'-dimethylbenzidine

In a 300 ml-three-necked flask equipped with a Dimroth condenser were charged 8.68 g (0.0200 mole) of 3,3'-dimethyl-4,4'-diidobiphenyl, 6.77 g (0.0400 mole) of diphenylamine, 8.29 g (0.0600 mole) of potassium carbonate, 1.2 g of copper powder and 30 ml of sulfolane, and the reaction was carried out under nitrogen atmosphere at 230° C. for 28 hours with stirring. Then, the reaction mixture was cooled to about 100° C., and 200 ml of water was added thereto, followed by heating for 15 minutes with stirring and removing the resulting supernatant liquid. This procedure was repeated twice. To the residue was added 100 ml of methanol, and a similar procedure was repeated again. Thereafter, the residue was dissolved in methylene chloride and the solution was dried over anhydrous sodium sulfate. The solvent was removed by distillation to obtain brown oil. The oil was subjected to column chromatography using an alumina column and was eluted with a mixed solvent of n-hexane/methylene chloride (4/1 by volume) to obtain 5.0 g of colorless oil, which was then crystallized from a mixed solvent of n-hexane/ether. The resulting colorless crystal having a melting point of 165°-175° C. was recrystallized from a mixed solvent of benzene/-hexane to obtain 3.2 g (yield: 31%) of a colorless powdery crystal having a melting point of 175°-178° C.

Elemental Analysis for $C_{38}H_{32}N_2$

| | | | |
|---|---|---|---|
| Calculated (%) | C 88.33 | H 6.24 | N 5.42 |
| Found (%) | C 88.37 | H 6.21 | N 5.26 |

SYNTHESIS EXAMPLE 4

Preparation of N,N'-Diphenyl-N,N'-bis-(3-methylphenyl)-3,3'-dimethylbenzidine A mixture of 8.68 g (0.0200 mole) of 3,3'-dimethyl-4,4'-diidodobiphenyl, 7.33 g (0.0400 mole) of 3-methyldiphenylamine, 8.29 g (0.0600 mole) of potassium carbonate, 1.2 g of copper powder and 30 ml of sulfolane was reacted under nitrogen atmosphere at 220° C. for 18 hours with stirring. Then, the reaction mixture was cooled to about 100° C., and 200 ml of water was added thereto, followed by heating for 15 minutes with stirring and removing the resulting supernatant liquid. This procedure was repeated twice. Thereafter, the residue was dissolved in methylene chloride and filtered, and the filtrate was dried over sodium sulfate. The solvent was removed by distillation to obtain 12.7 g of brown oil. The oil was then subjected to column chromatography using an alumina column and was eluted with a mixed solvent of n-hexane/methylene chloride (4/1 by volume) to obtain 4.42 g (yield: 40%) of a colorless solid product, from which a colorless powdery crystal having a melting point of 140°-143° C. was obtained by further purification using the alumina column.

Elemental Analysis for $C_{40}H_{36}N_2$

| | | | |
|---|---|---|---|
| Calculated (%) | C 88.20 | H 6.66 | N 5.14 |
| Found (%) | C 88.06 | H 6.54 | N 5.23 |

The conductive support to be used in the photoreceptors of the present invention can be selected from conventionally known supports, such as a plate of foil of metals, e.g., aluminum, and a plastic film deposited or coated with a conductive material, e.g., metals.

The photoconductive layer provided on the conductive support may have either a single layer structure or a layer structure of separated function composed of a charge generating layer and a charge transport layer.

In the case where the photoconductive layer comprises a single layer, the compound of formula (I) is preferably used in an amount of from 50 to 180% by weight, more preferably from 55 to 150% by weight, based on the weight of the binder resin. In the case, the photoconductive layer further contains a charge generating material generally in an amount of from 2 to 30% by weight, preferably form 5 to 15% by weight based on the weight of the binder resin. The thickness of the photoconductive layer is generally from 5 to 50 μm.

The binder resins which can be used for binding the compound of the formula (I) are selected from film-forming resins, such as polyarylate resins, polysulfone resins, polyamide resins, acrylic resins, acrylonitrile resins, methacrylic resins, vinyl chloride resins, vinyl acetate resins, phenolic resins, epoxy resins, alkyd resins, bisphenol A polycarbonate, polyurethane, and copolymer resins comprising at least two vinyl monomers, e.g., a styrene-butadiene copolymer, a styrene-acrylonitrile copolymer, a styrene-maleic acid copolymer, etc. Photoconductive polymers, e.g., poly-N-vinylcarbazole, polyvinylanthracene, polyvinylpyrene, etc., may also be used as binder.

Any known charge generating materials may be employed in the present invention. Examples of inorganic charge generating materials include selenium, trigonal selenium, selen-tellurium, selen-arsenic, cadmium sulfideseleninium, cadmium sulfide, etc. Examples of organic charge generating materials include squalirium dyestuffs, azo pigments (e.g., monoazo pigments, bisazo pigments, trisazo pigments, etc.), phthalocyanine pigments (e.g., metal-free phthalocyanine pigments and metallo-phthalocyanine), polycyclic quinone pigments (e.g., dibenzopyrenequinone pigments, pyranthrone pigments, anthanthrone pigments, etc.), perylene pigments (e.g., perylenic anhydride, perylenic acid imide, etc.), and the like. If desired, these charge generating materials may be used in combination with various sensitizers.

In the case where the photoconductive layer has a layer structure of separated function composed of a charge generating layer and a charge transport layer, the compound of formula (I) is incorporated into a charge transport layer. The amount of the compound of formula (I) to be incorporated ranges preferably from 10 to 80% by weight, more preferably from 30 to 60% by weight, based on the total solid content of the charge transport layer.

In the above case, the binder resins to be used in the charge transport layer can be selected from those enumerated above. In particular, a combination of the compound of formula (I) with an ester resin selected from polycarbonate resins, polyester carbonate resins, and polyarylate resins is preferred for the charge transport layer since it simultaneously satisfied both electrical requirements (e.g., charging properties and sensitivity) and mechanical requirements (e.g., abrasion resistance and toner filming properties). These resins may be used in combination thereof in the form of a polymer blend of a polycarbonate resin and a polyester carbonate resin or a polymer blend of a polycarbonate resin and a polyarylate resin. As polycarbonate resin, it is preferred to use bisphenol Z polycarbonate alone. A polymer blend of a bisphenol Z polycarbonate resin and a polyester carbonate resin or a polymer blend of a bisphenol Z polycarbonate resin and a polyarylate resin is also preferred.

The above-described binder resins that are preferred for use in combination with the compounds of the present invention in the charge transport layer will be explained in detail below.

The polycarbonate resins have a basic repeating unit represented by, for example, formula (XII)

(XII)

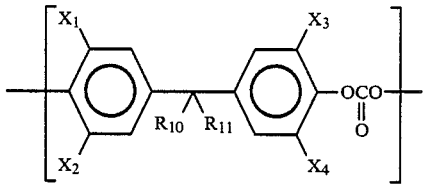

wherein $R_{10}$ and $R_{11}$ each represents a hydrogen atom, an acyl group preferably having from 2 to 5 carbon atoms, an alkyl group preferably having from 1 to 4 carbon atoms, or a phenyl group, or they are connected together to form a ring (e.g., 5- or 6-membered ring); and $X_1$, $X_2$, $X_3$, and $X_4$ each represents a hydrogen atom, an alkyl group preferably having 1 or 2 carbon atoms, or a halogen atom (e.g., a chlorine atom and a bromine atom).

Of these polycarbonate resins, one having a repeating unit of formula

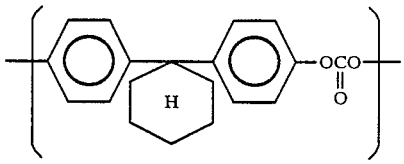

is bisphenol Z polycarbonate.

The polyester carbonate resins have a basic repeating unit represented by, for example, formula (XIII)

(XIII)

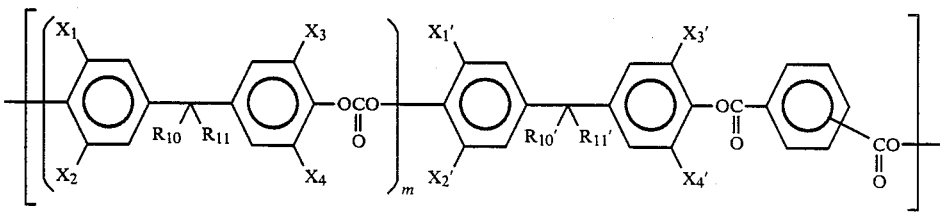

wherein $R_{10}$, $R_{11}$, $X_1$, $X_2$, $X_3$, and $X_4$ are as defined above; $R_{10}'$, $R_{11}'$, $X_1'$, $X_2'$, $X_3'$, and $X_4'$ are groups as defined for $R_{10}$, $R_{11}$, $X_1$, $X_2$, $X_3$, and $X_4$, respectively; and m represents an integer preferably from 1 to 100.

The polyarylate resins have a basic repeating unit represented by, for example, formula (XIV)

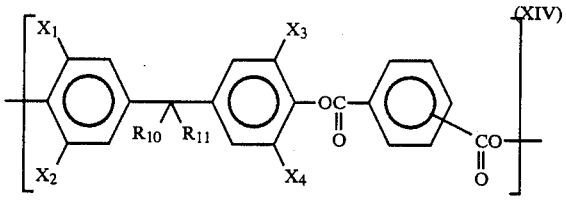

(XIV)

wherein $R_{10}$, $R_{11}$, $X_1$, $X_2$, $X_3$, and $X_4$ are as defined above.

The above-described polycarbonate resins, polyester carbonate resins, and polyarylate resins to be used as binder resins in the present invention usually have a weight average molecular weight of from 10,000 to 150,000, preferably from 20,000 to 150,000, and more preferably from 25,000 to 100,000.

Specific examples of the polycarbonate resins having the basic repeating unit of formula (XII) include the aforesaid bisphenol Z polycarbonate and, in addition, the following resins wherein n represents a degree of polymerization (hereinafter the same).

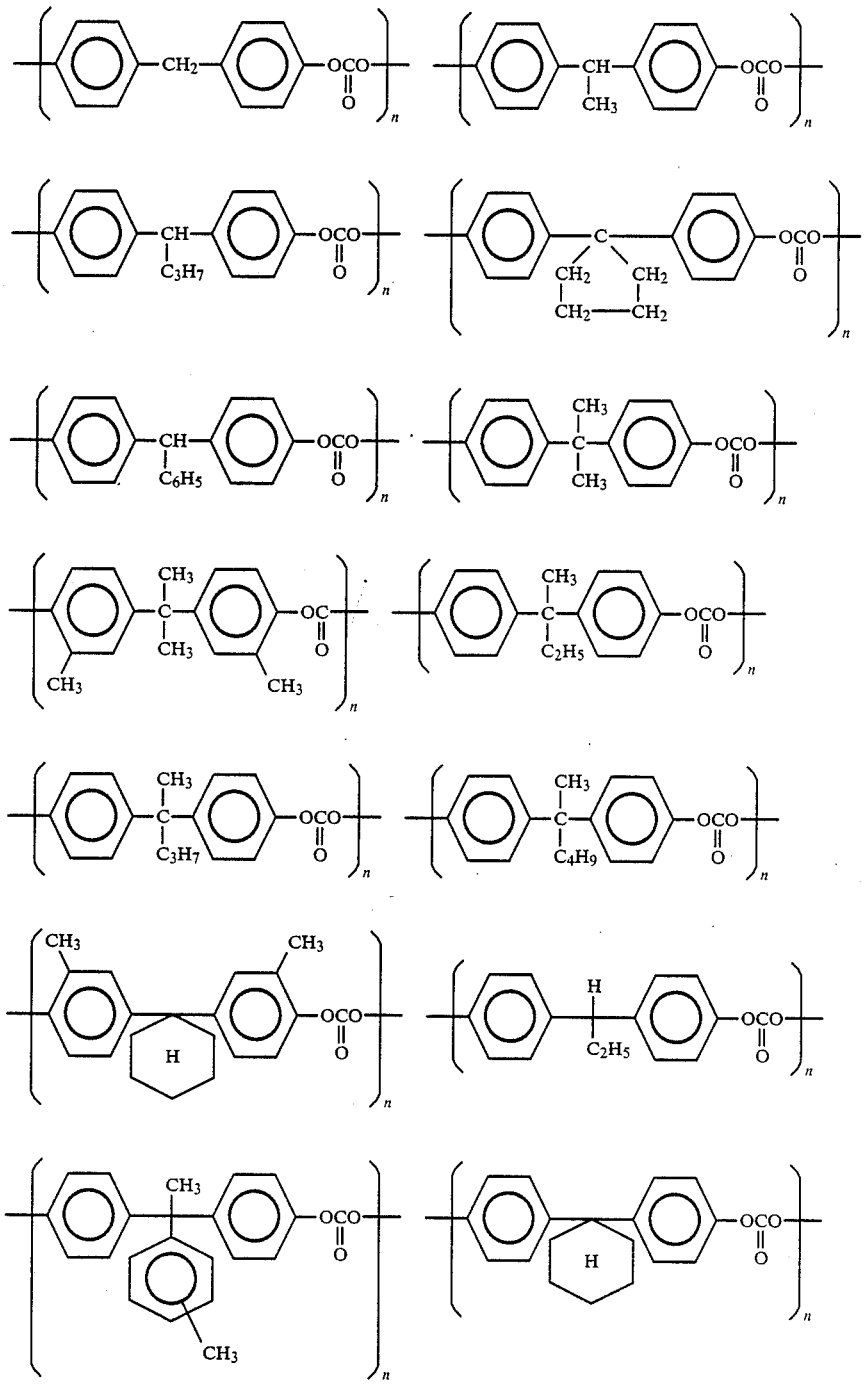

-continued
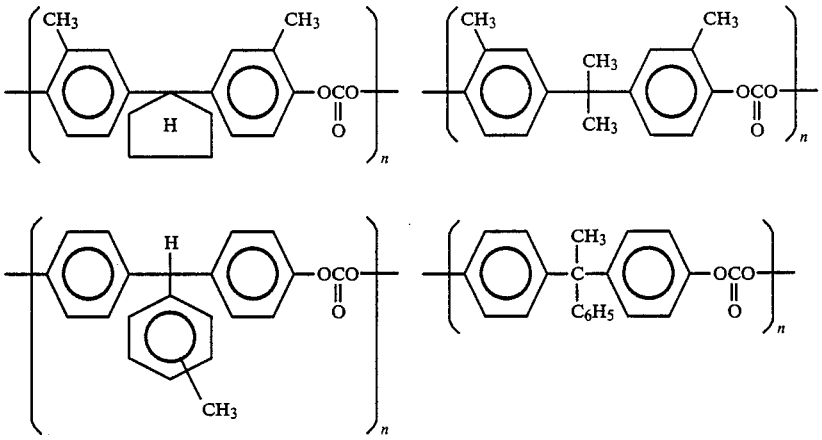
Specific examples of the polyester carbonate resins having the basic repeating unit of formula (X) are shown below.
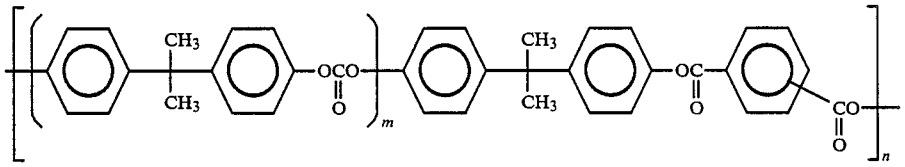
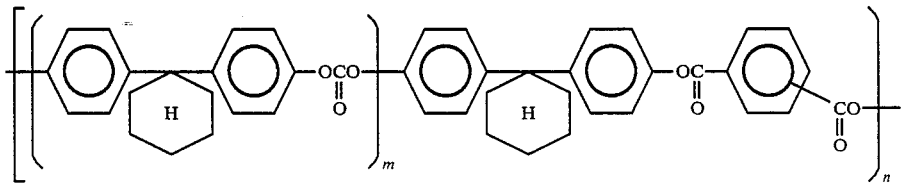
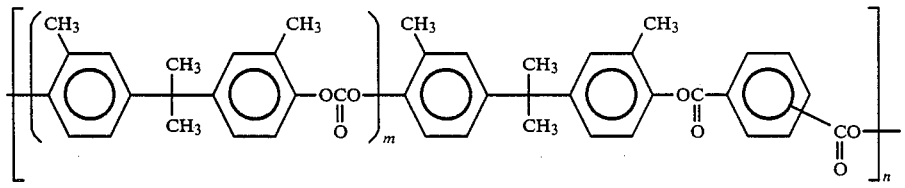
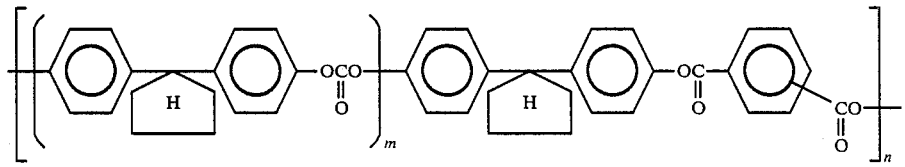
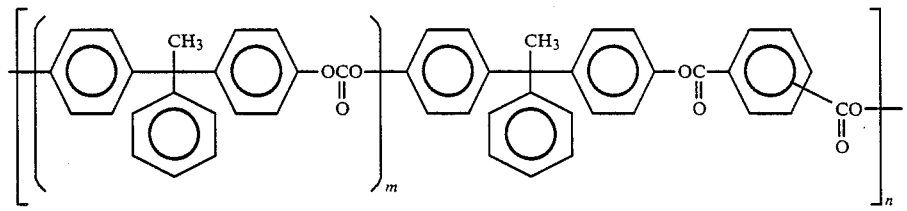

-continued
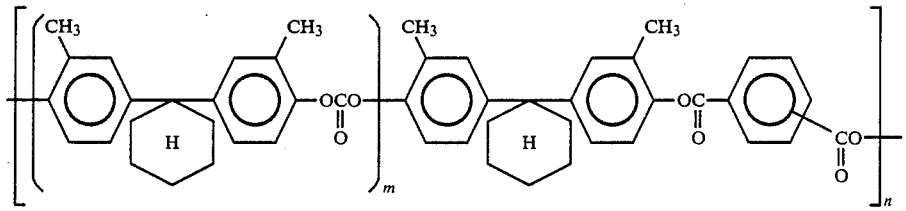
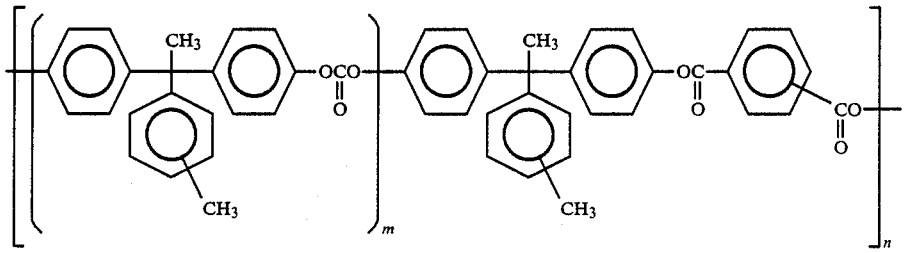
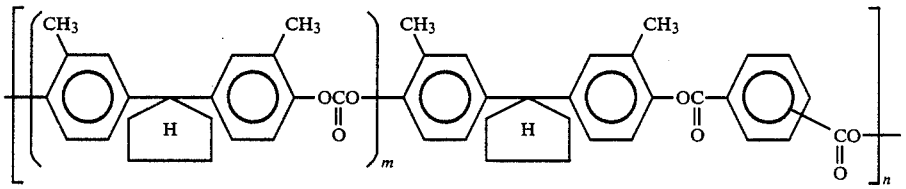
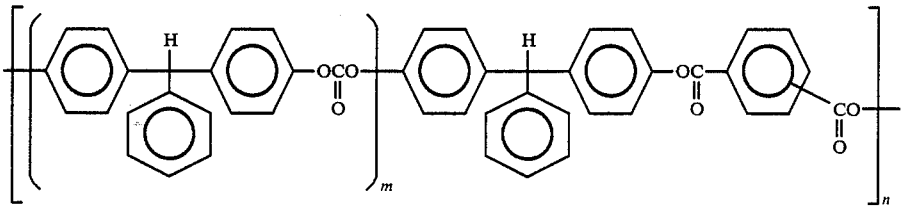
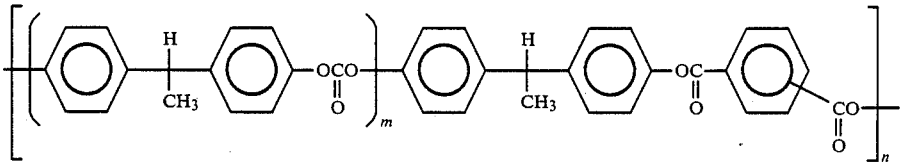
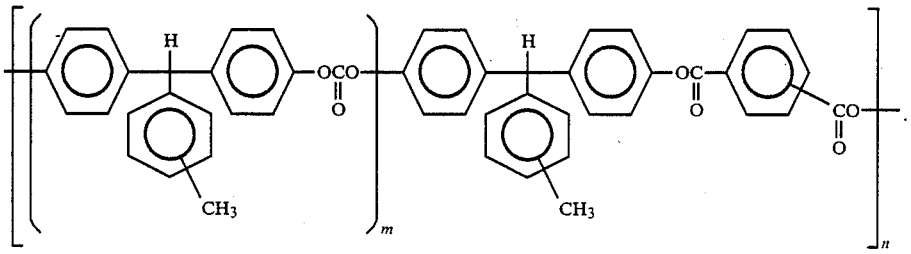
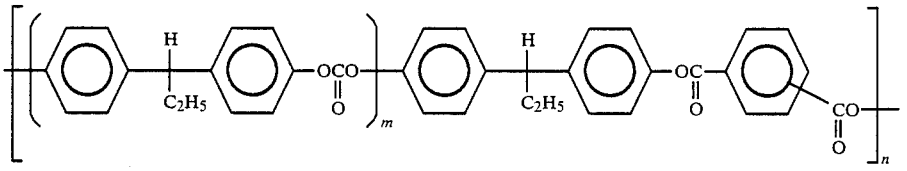
specific examples of the polyarylate resins having the basic repeating unit of formula (XIV) are shown below.

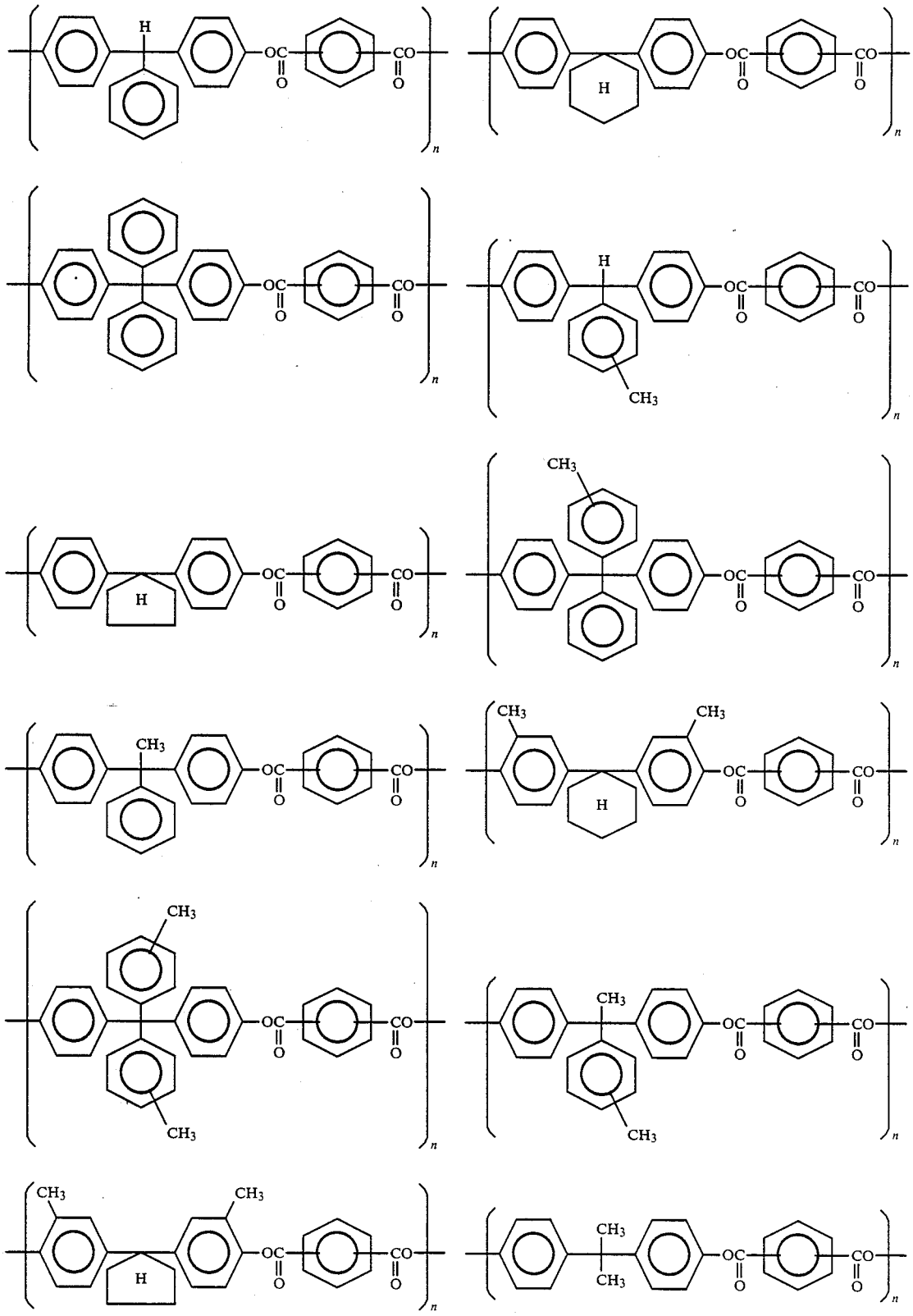
Any of the conventionally known charge generating materials as enumerated above may be used in the charge generating layer. If desired, these charge generating materials may be used in combination with various resins or sensitizers.
The resins which can be used in combination include polyamide, polyurethane, polyester, epoxy resins, polyketone, polycarbonate, polyvinyl ketone, polystyrene, poly-N-vinylcarbazole, polyacrylamide, etc.

In the photoconductive layer of separated function type, the charge generating layer and the charge transport layer may not be distinctly separated and the layer composition may be continuously varied from a charge generating zone through a charge transport zone.

The order of providing the charge generating layer and the charge transport layer is not limited. When the charge generating layer is provided as an upper layer, the resulting photoreceptor can be charged positively. When the charge transport layer is provided as an upper layer, the resulting photoreceptor can be charged negatively.

In the photoreceptor according to the present invention, the charge generating layer preferably has a thickness of 5 μm or less, and more preferably 2 μm or less, and the charge transport layer preferably has a thickness of from 3 to 50 μm, and more preferably from 5 to 25 μm. If desired, the photoreceptor may further contain a protective layer, an adhesive layer, and the like.

The present invention will now be illustrated in greater detail with reference to the following examples, but the present invention should not be construed as being limited thereto. In these examples, all the parts are given by weight unless otherwise indicated.

EXAMPLE 1

A methylene chloride solution containing 1 part of chlorinated Dian Blue having the structure shown below, 10 parts of a compound having the structure shown below as a charge transport material, and 10 parts of a polycarbonate resin ("Makrolon 5705" produced by Bayer A.G.) was dispersed in a paint shaker for 2 hours. The resulting coating composition was coated on an Al vacuumdeposited Mylar base with a wire bar to a dry thickness of 12 μm, followed by drying at 100° C. for 1 hour.

Chlorinated Dian Blue:

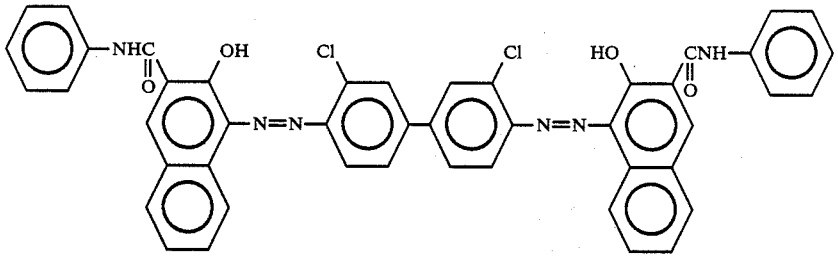

Charge Transport Material:

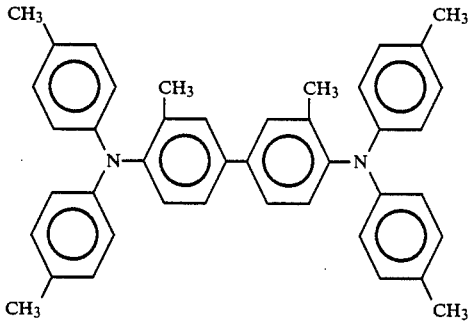

The resulting electrophotographic photoreceptor was found to have a sensitivity ($E_{\frac{1}{2}}$: minimum exposure required for reducing the initial surface potential to $\frac{1}{2}$) of 5.2 lux.sec as measured by a device, "SP 428" manufactured by Kawaguchi Denki K.K.

EXAMPLE 2

An electrophotographic photoreceptor was produced in the same manner as in Example 1, except for replacing the chlorinated Dian Blue with a perylene pigment ("Novoperm Red BL"). The photoreceptor had a sensitivity ($E_{\frac{1}{2}}$) of 6.5 lux.sec as measured in the same manner as in Example 1.

EXAMPLE 3

An electrophotographic photoreceptor was produced in the same manner as in Example 1, except for replacing the charge transport material as used in Example 1 with a compound having the following structure.

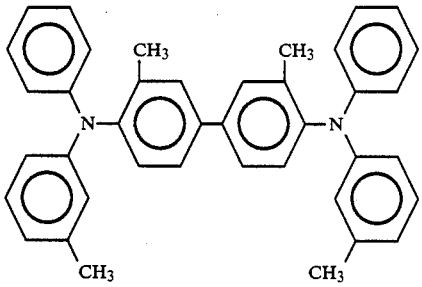

The resulting photoreceptor had a sensitivity ($E_{\frac{1}{2}}$) of 5.4 lux.sec as measured in the same manner as in Example 1.

EXAMPLE 4

An electrophotographic photoreceptor was produced in the same manner as in Example 1, except for replacing the chlorinated Dian Blue with the perylene pigment as used in Example 2 and replacing the charge transport material as used in Example 1 with that used in Example 3. The resulting photoreceptor had a sensitivity ($E_{\frac{1}{2}}$) of 6.8 lux.sec as determined in the same manner as in Example 1.

EXAMPLES 5 TO 7 AND COMPARATIVE EXAMPLES 1 TO 4

A charge generating layer containing polyvinylcarbazole and 7% by volume of trigonal selenium (Tri-Se) was coated on a conductive base. A solution containing 3.0 g of a charge transport material as shown in Table 2, 3.0 g of a binder resin as shown in Table 2, and 34.0 g of methylene dichloride was coated on the charge generating layer to a dry thickness of 25 μm, followed by drying at 80° C. for 2 hours to produce an electrophotographic photoreceptor.

The electrical characteristic ($E_{\frac{1}{4}}$: minimum exposure required for reducing the initial surface potential to $\frac{1}{4}$) of each of the resulting photoreceptors was measured by SP 428, and the results obtained are shown in Table 2.

Abbreviations used in Table 2 have the following meanings.

PC(Z): Bisphenol Z polycarbonate resin (produced by Mitsubishi Gas Chemical Ind., Ltd.; molecular weight 54,000)

PEC: Polyester carbonate resin ("C300A" produced by Mitsubishi Chemical Ind., Ltd.)

PA: Polyarylate resin ("U polymer U-100" produced by Unitika Ltd.)

TABLE 2

| Example No. | Charge transport material | Binder resin | $E_{\frac{1}{4}}$ (lux · sec) |
|---|---|---|---|
| 5 | 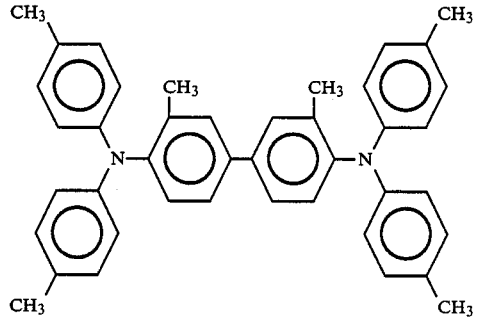 | PC(Z) | 1.30 |
| 6 | 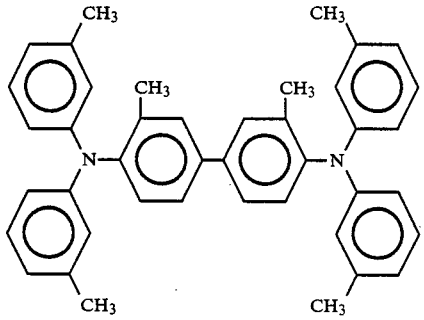 | PC(Z)/PEC (60/40)* | 1.40 |
| 7 | 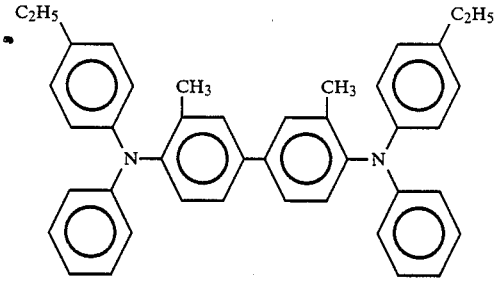 | PC(Z)/PA (60/40)* | 1.70 |
| Comparative Ex. 1 | 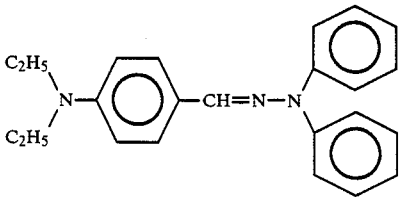 | PC(Z) | 2.7 |
| Comparative Ex. 2 | 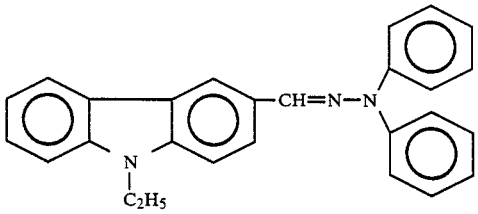 | PC(Z) | 8.8 |

TABLE 2-continued

| Example No. | Charge transport material | Binder resin | $E_{\frac{1}{4}}$ (lux · sec) |
|---|---|---|---|
| Comparative Ex. 3 | 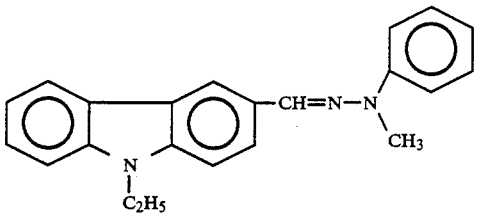 | PC(Z) | 28.5 |
| Comparative Ex. 4 | 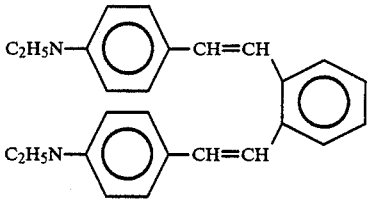 | PC(Z) | not measured** |

Notes:
*Mixing ratios in parentheses by weight.
**The film was whitened due to incompatibility between the charge transport material and the binder resin.

EXAMPLE 8

Electrophotographic photoreceptors were produced in the same manner as in Examples 5 to 7, except for using charge transport materials and binder resins shown in Table 3 below. The electric characteristic ($E_{\frac{1}{4}}$) of each of the resulting photoreceptors is shown in Table 3.

TABLE 3

| Charge transport material | Electric characteristic $E_{\frac{1}{4}}$(lux · sec) PC(Z) | PC(Z)/PEC (1.5 g/1.5 g) | PC(Z)/PA (1.5 g/1.5 g) |
|---|---|---|---|
| 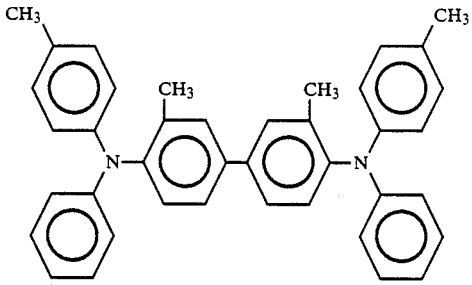 | 1.35 | 1.35 | 1.25 |
| 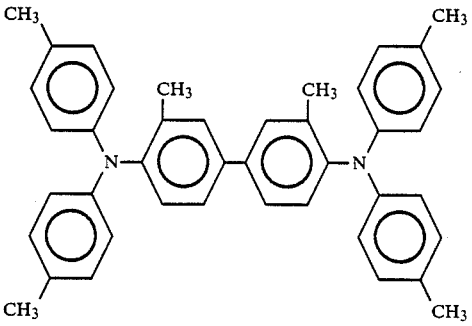 | 1.20 | 1.25 | 1.20 |

TABLE 3-continued

| Charge transport material | Electric characteristic $E_{\frac{1}{2}}$(lux · sec) PC(Z) | PC(Z)/PEC (1.5 g/1.5 g) | PC(Z)/PA (1.5 g/1.5 g) |
|---|---|---|---|
| 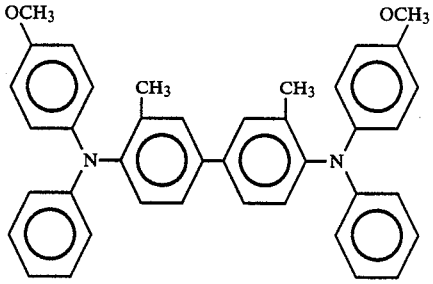 | 1.30 | 1.25 | 1.20 |
| 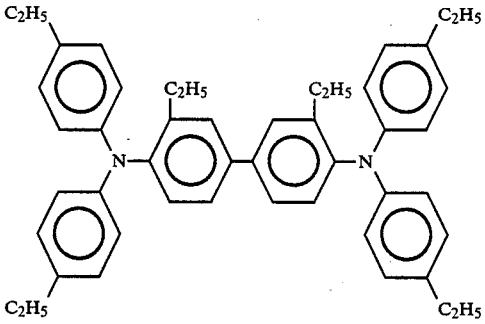 | 1.20 | 1.20 | 1.25 |
| 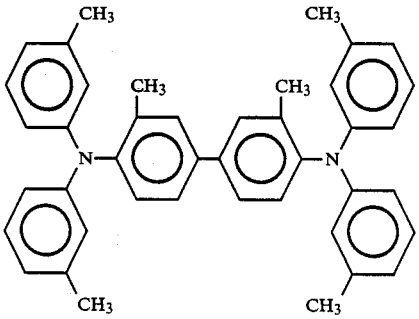 | 1.45 | 1.35 | 1.30 |
| 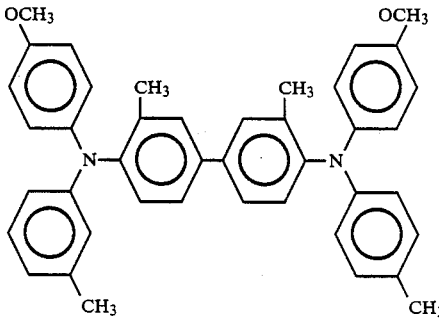 | 1.40 | 1.40 | 1.20 |

EXAMPLE 9 AND COMPARATIVE EXAMPLE 5

A charge generating layer containing polyvinylcarbazole and 7% by volume of Tri-Se was coated on a conductive support to a thickness of 2.5 μm. A solution of 3 g of a compound having the structure shown below as a charge transport material and 3 g of polycarbonate resin ("Makrolon 5707" produced by Bayer A.G.) in 34 g of methylene chloride was coated on the charge generating layer with an applicator to a dry thickness of 25 μm and dried at 80° C. for 2 hours to obtain an electrophotographic photoreceptor (Example 9).

Charge Transport Material:

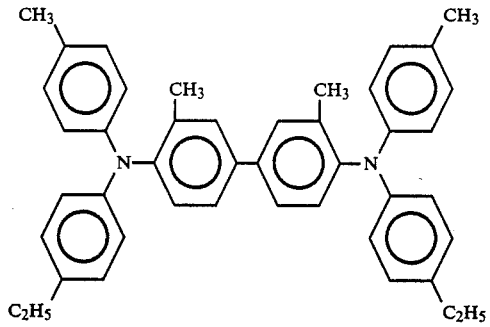

For comparison, an electrophotographic photoreceptor was produced in the same manner as in Example 9, except for using a compound having the structure shown below as a charge transport material (Comparative Example 5).

Comparative Charge Transport Material:

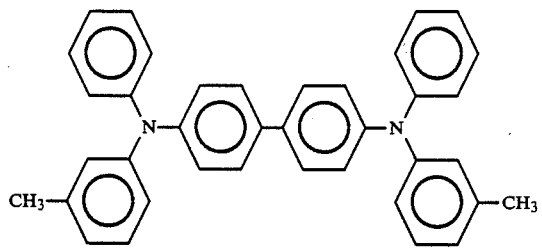

Each of the resulting photoreceptors was mounted on a copying machine (a modified "FX 2700" manufactured by Fuji Zerox Co., Ltd.), and copying was repeatedly carried out under a high temperature and high humidity condition (28° C., 85% RH: Condition I), a normal temperature and normal humidity condition (25° C., 40% RH: Condition II) or a low temperature and low humidity condition (10° C., 30% RH: Condition III). The electrophotographic performance of the photoreceptor on copying 100 times and 20,000 times was determined as follows. Initial charging was effected by applying a current of 10 μA to a single corotron wire, and a potential immediately after charging $V_{DDP}$ was measured. The photoreceptor was then exposed to light of 300 erg/cm$^2$ emitted from a fluorescent lamp, and a residual potential $V_{RP}$ was measured. The results obtained are shown in Table 4.

TABLE 4

| Example No. | Copying condition | $V_{DDP}$ 100 Times (V) | $V_{DDP}$ 20,000 Times (V) | $V_{RP}$ 100 Times (V) | $V_{RP}$ 20,000 Times (V) |
|---|---|---|---|---|---|
| 9 | I | −810 | −750 | −30 | −30 |
| | II | −800 | −730 | −30 | −30 |
| | III | −790 | −720 | −35 | −40 |
| Comparative Ex. 5 | I | −770 | −570 | −20 | −35 |
| | II | −800 | −550 | −20 | −35 |
| | III | −780 | −540 | −40 | −55 |

It can be seen from Table 4 that the photoreceptor according to the present invention is superior to the comparative one in $V_{DDP}$-$V_{RP}$ cycle stability and environmental stability.

EXAMPLES 10 AND 11

An electrophotographic photoreceptor was produced in the same manner as in Example 9, except for replacing the charge transport material as used in Example 9 with a compound having the following structure (Example 10).

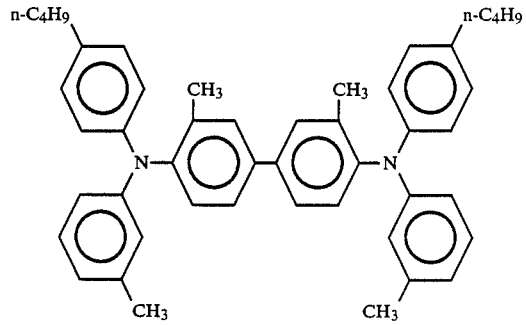

An electrophotographic photoreceptor was produced in the same manner as in Example 10, except for replacing Macrolon 5707 used as binder resin for the charge transport layer with bisphenol Z polycarbonate (produced by Mitsubishi Gas Chemical Ind., Ltd.; molecular weight 75,000) (Example 11).

Each of the resulting photoreceptors was evaluated for electrophotographic performance in terms of $V_{DDP}$ and $V_{RP}$ in the same manner as in Example 9 as well as $E_{1/5}$ (minimum exposure required for reducing the initial surface potential to 1/5; measured after 100 copying cycles at 25° C. and 40% RH). The results obtained are shown in Table 5 below.

TABLE 5

| Example No. | $V_{DDP}$ (V) | $V_{RP}$ (V) | $E_{1/5}$ (lux · sec) |
|---|---|---|---|
| 10 | −770 | −20 | 1.6 |
| 11 | −780 | −10 | 1.5 |

EXAMPLE 12 AND COMPARATIVE EXAMPLE 6

One part of a polyvinylbutyral resin (produced by Sekisui Chemical Co., Ltd.) was dissolved in 19 parts of cyclohexanone. Twenty parts of the resulting solution and 8 parts of a dibromoanthanthrone pigment ("C.I. Pigment Red 168") were mixed and dispersed. To the dispersion was further added cyclohexanone to prepare a coating composition for charge generating layer. A charge generating layer was formed on an aluminum pipe to a thickness of 2 μm by the use of a dip-coating apparatus as shown in FIG. 1.

In FIG. 1, coating composition 1 was fed to tank 2 through filter 12 from feed inlet 7 by means of pump 10. Overflow 4 from tank 2 was received by overflow groove 9 and recycled to feed tank 11 through outlet 6. Cylindrical base 3 was vertically moved by an appropriate means and dipped in coating composition 1. On the upper part of tank 2 were provided wall 5 and a cover 8 for overflow groove 9.

Each of the coating compositions shown in Table 6 was then dip-coated on the thus formed charge generating layer by the use of the same dip-coating apparatus as used above to form a charge transport layer. Conditions for dip coating are also shown in Table 6.

TABLE 6

| | Example 12 | Comparative Example 6 |
|---|---|---|
| Composition: | | |
| Charge transport material | 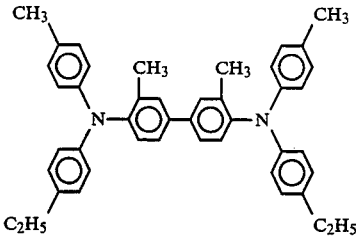 | 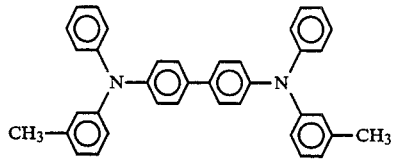 |
| Binder resin resin | 5 parts bisphenol Z polycarbonate 6 parts | 5 parts bisphenol Z polycarbonate 6 parts |
| Solvent | monochlorobenzene 32 parts | monochlorobenzene 40 parts |
| Coating condition: | | |
| Take-up rate | 95 mm/min | 110 mm/min |
| Film thickness | 20 μm at the center | 20 μm at the center |

Figure 2:
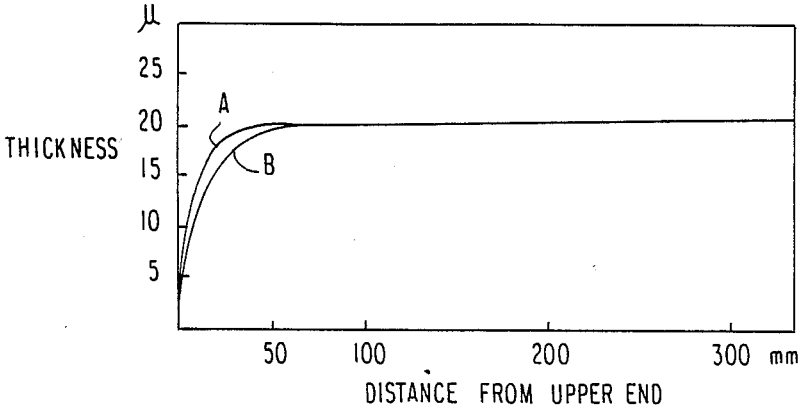
FIG. 2 shows sagging of a charge transport layer as observed in photoreceptors of Example 12 and Comparative Example 6.

The sagging of the coating film at the upper end of the resulting photoreceptors is shown in FIG. 2, in which symbols A and B indicate Example 12 and Comparative Example 6, respectively. As can be seen from the FIG. 2, sagging was observed in the area of 30 mm distant from the upper end in the photoreceptor of Example 12, while it was obserbed, in the area of 50 mm distant from the upper end in the sample of Comparative Example 6.

EXAMPLE 13 AND COMPARATIVE EXAMPLE 7

On an aluminum pipe was formed a 2 μm-thick charge generating layer in the same manner as in Example 12. A coating composition containing a compound having the structure shown below, bisphenol Z polycarbonate, and monochlorobenzene at a weight ratio of 7/13/49 was then coated on the charge generating layer by the use of the same apparatus as described in Example 12, followed by drying at 100° C. for 60 minutes to form a charge transport layer having a thickness of 20 μm (Example 13).

Charge Transport Material:

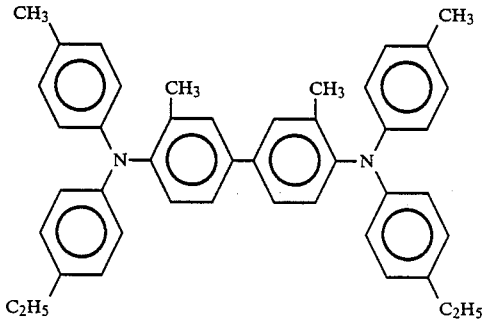

For comparison, an electrophotographic photoreceptor was produced in the same manner as above, except for using a coating composition comprising a compound having the structure shown below, bisphenol Z polycarbonate, and monochlorobenzene at a weight ratio of 7/13/60 (Comparative Example 7).

Comparative Charge Transport Material:

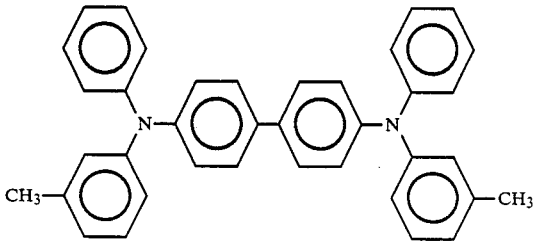

The photoelectric performance of each of the resulting photoreceptors was evaluated by determining $V_{DD}$ and $V_{RP}$ on the 100th copying cycle in the same manner as in Example 9, except for changing the quantity of light for exposure after charging to 100 erg/cm$^2$ and copying was carried out under Condition IV (35° C., 85% RH), V (20°0 C., 40% RH) or VI (5° C., 20% RH). Further, the charged photoreceptor was exposed to light of 550 nm at 8 erg/cm$^2$, and the potential immediately after the exposure (background potential: $V_{BKG}$) was determined on the 100th copying cycle. The results obtained are shown in Table 7 below.

TABLE 7

| Environmental condition | Example 13 $V_{DDP}$ (V) | Example 13 $V_{BKG}$ (V) | Example 13 $V_{RP}$ (V) | Comparative Example 7 $V_{DDP}$ (V) | Comparative Example 7 $V_{BKG}$ (V) | Comparative Example 7 $V_{RP}$ (V) |
|---|---|---|---|---|---|---|
| IV | −930 | −80 | −20 | −950 | −80 | −40 |
| V | −960 | −75 | −15 | −940 | −100 | −50 |
| VI | −900 | −85 | −25 | −920 | −150 | −80 |

Further, copying was carried under environmental conditions of 25° C. and 40% RH, and the electrophotographic characteristics on the 100th and 10,000th copying cycles were determined. The results obtained are shown in Table 8 below.

TABLE 8

| Number of cycles | Example 13 $V_{DDP}$ (V) | Example 13 $V_{BKG}$ (V) | Example 13 $V_{RP}$ (V) | Comparative Example 7 $V_{DDP}$ (V) | Comparative Example 7 $V_{BKG}$ (V) | Comparative Example 7 $V_{RP}$ (V) |
|---|---|---|---|---|---|---|
| 100 | −970 | −80 | −15 | −950 | −100 | −50 |
| 10,000 | −910 | −85 | −15 | −750 | −55 | −50 |

As described above, the compounds represented by formula (I) according to the present invention exhibit very good compatibility with binder resins to be used in a photoconductive layer and satisfactory resistance to oxidation. Therefore, the electrophotographic photoreceptors using the compounds of the present invention as charge transfer material are clearly charged and do not undergo photo-fatigue on repeated use.

Further, when the compounds of the present invention are used in combination with a binder resin selected from polycarbonate resins, e.g., a bisphenol Z polycarbonate resin, polyester carbonate resins, and polyarylate resins, they are entirely free from adverse influences from these resins despite that these resins contain a phenyl ester group in the molecule thereof. Therefore, the photoreceptors using the above-described combination exhibit excellent electrophotographic performance. Besides, since these binder resins are excellent in corrosion resistance with solvents, when a photoconductive layer is composed of two or more laminated layers, the resins do not cause disturbance on the interface between the layers, thus avoiding deterioration in electric characteristics due to interface disturbance.

Of the compounds of formula (I), those represented by formula (III) are particularly beneficial in forming a layer by dip coating owing to their very high solubility in solvents. In other words, use of these compounds reduces the requisite amount of a solvent and increases the viscosity of a coating composition so that a coating film of a prescribed thickness can be formed even at a decreased take-up rate of a dip-coated substrate. Since the take-up rate of the substrate can thus be decreased, uneven coating (i.e., sagging of a coating film) at the end portion of the substrate in the take-up direction can be minimized, thus broadening the surface area of the electrophotographic photoreceptors. In addition, the electrophotographic photoreceptors using the compounds of formula (III) are also superior in electrophotographic performance.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive support having provided thereon a photoconductive layer containing a charge transport material represented by formula (I)

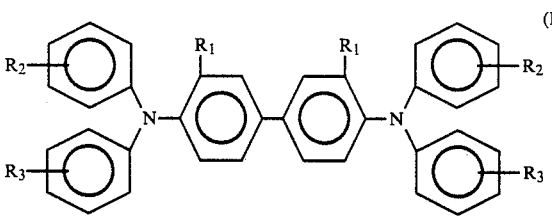

wherein $R_1$ represents an alkyl group, and $R_2$ and $R_3$, which may be the same or different, each represents a hydrogen atom, an alkyl group, an alkoxy group, a halogen atom, an alkoxycarbonyl group, or a substituted amino group.

2. An electrophotographic photoreceptor comprising an electrically conductive support having provided thereon a photoconductive layer containing a charge transport material represented by formula (II)

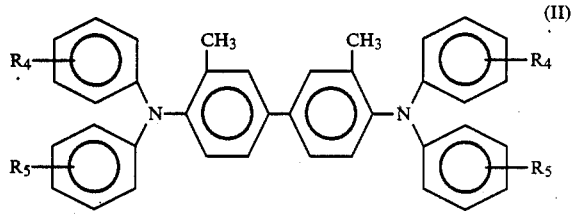

wherein $R_4$ and $R_5$, which may be the same or different, each represents a hydrogen atom or a methyl group.

3. An electrophotographic photoreceptor comprising an electrically conductive support having provided thereon a photoconductive layer containing a charge transport material represented by formula (III)

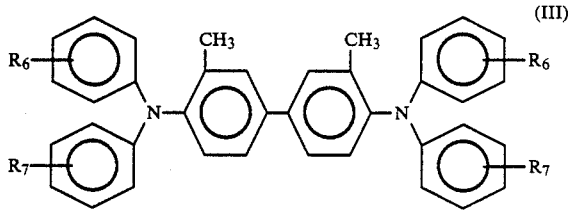

wherein at least one of $R_6$ and $R_7$ represents an alkyl group having 2 or more carbon atoms, and the other represents a hydrogen atom, an alkyl group, an alkoxy group, a halogen atom, an alkoxycarbonyl group or a substituted amino group.

4. An electrophotographic photoreceptor comprising an electrically conductive support having provided thereon a photoconductive layer containing a charge transport material having the structural formula (IV)

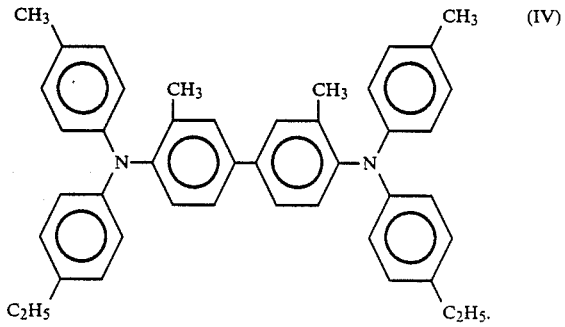

5. An electrophotographic photoreceptor comprising an electrically conductive support having provided thereon a photoconductive layer containing a charge transport material having the structural formula (V)

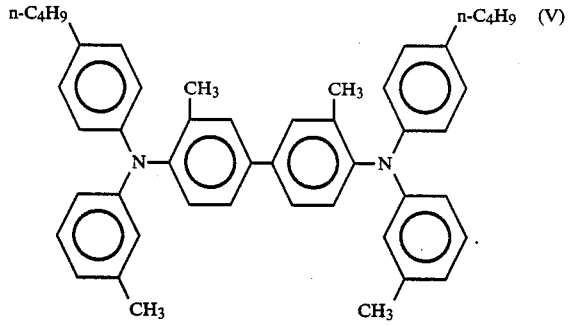

(V)

6. An electrophotographic photoreceptor as claimed in claim 1, wherein said photoconductive layer is composed of a charge generating layer and a charge transport layer, the charge transport layer comprising a binder resin having dispersed therein the charge transport material represented by formula (I).

7. An electrophotographic photoreceptor as claimed in claim 6, wherein said binder resin is an ester resin selected from the group consisting of polycarbonate resins, polyester carbonate resins, and polyarylate resins.

8. An electrophotographic photoreceptor as claimed in claim 7, wherein said binder resin is a polymer blend comprising a polycarbonate resin and a polyester carbonate resin, or a polymer blend comprising a polycarbonate resin and a polyarylate resin.

9. An electrophotographic photoreceptor as claimed in claim 7, wherein said polycarbonate resins are bisphenol z polycarbonate resins.

10. A process for producing a charge transport material represented by formula (VIII)

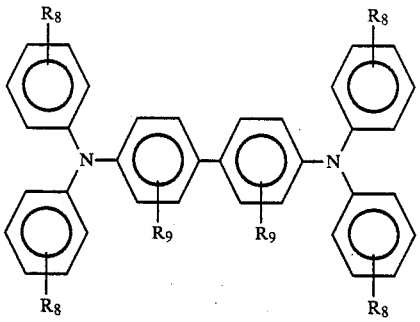

(VIII)

wherein $R_8$ represents a hydrogen atom, an alkyl group, an alkoxy group, a halogen atom, an alkoxycarbonyl group, or a substituted amino group, and $R_9$ represents a hydrogen atom, an alkyl group, or an alkoxy group, which comprises reacting a halogenated derivative represented by formula (VI)

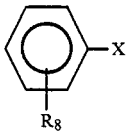

(VI)

wherein $R_8$ is as defined above, and x represents an iodine atom or a bromide atom, with a benzidine derivative represented by formula (IX)

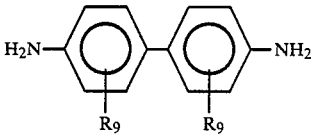

(IX)

wherein $R_9$ is as defined above in the presence of a copper catalyst and an alkali.

11. A process as claimed in claim 10, wherein the reaction is carried out in a high-boiling hydrocarbon solvent.

12. An electrophotographic photoreceptor as claimed in claim 2, wherein said photoconductive layer is composed of a charge generating layer and a charge transport layer, the charge transport layer comprising a binder resin having dispersed therein the charge transport material represented by formula (II)

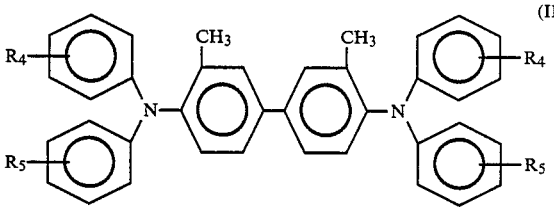

(II)

wherein $R_4$ and $R_5$, which may be the same or different, each represents a hydrogen atom or a methyl group.

13. An electrophotographic photoreceptor as claimed in claim 3, wherein said photoconductive layer is composed of a charge generating layer and a charge transport layer, the charge transport layer comprising a binder resin having dispersed therein the charge transport material represented by formula (III)

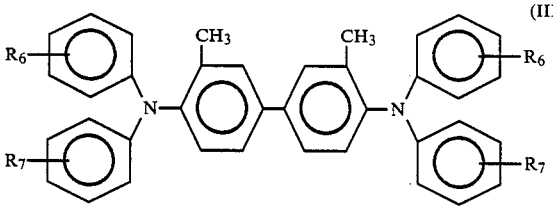

(III)

wherein at least one of $R_6$ and $R_7$ represents an alkyl group having 2 or more carbon atoms, and the other represents a hydrogen atom, an alkyl group, an alkoxy group, a halogen atom, an alkoxycarbonyl group or a substituted amino group.

14. An electrophotographic photoreceptor as claimed in claim 4, wherein said photoconductive layer is composed of a charge generating layer and a charge transport layer, the charge transport layer comprising a binder resin having dispersed therein the charge transport material having the structural formula (IV)

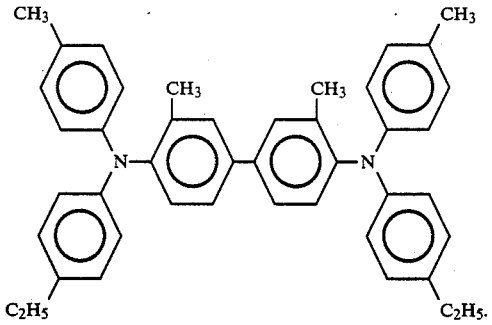
(IV)
15. An electrophotographic photoreceptor as claimed in claim 5, wherein said photoconductive layer is composed of a charge generating layer and a charge transport layer, the charge transport layer comprising a binder resin having dispersed therein the charge transport material having the structural formula (V)
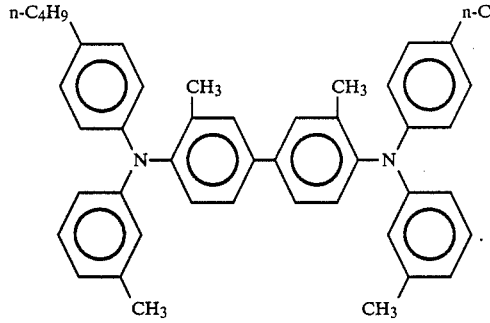
(V)
* * * * *